US005154007A

United States Patent [19]

Piunno et al.

[11] Patent Number: 5,154,007

[45] Date of Patent: * Oct. 13, 1992

[54] METHOD AND APPARATUS FOR CRYOPREPARING BIOLOGICAL TISSUE

[75] Inventors: Carmen Piunno, The Woodlands, Tex.; Stephen Livesey, Victoria, Australia; John G. Linner, The Woodlands, Tex.; Anthony A. del Campo, Houston, Tex.; Mark J. Zaltzberg, The Woodlands, Tex.

[73] Assignee: Board of Regents University of Texas System, Austin, Tex.

[ * ] Notice: The portion of the term of this patent subsequent to May 24, 2005 has been disclaimed.

[21] Appl. No.: 492,724

[22] Filed: Mar. 13, 1990

Related U.S. Application Data

[62] Division of Ser. No. 395,028, Aug. 17, 1989, Pat. No. 4,964,280.

[51] Int. Cl.[5] ..... F26B 5/06

[52] U.S. Cl. ..... 34/5; 34/92; 62/268; 62/100

[58] Field of Search ..... 34/5, 92; 62/268, 100, 62/78, 55.5; 55/269

[56] References Cited

U.S. PATENT DOCUMENTS

| | | | |
|---|---|---|---|
| 4,232,453 | 11/1980 | Edelmann | 34/92 |
| 4,510,169 | 4/1985 | Linner | 427/4 |
| 4,567,847 | 2/1986 | Linner | 118/50 |
| 4,676,070 | 6/1987 | Linner | 62/64 |
| 4,707,998 | 11/1987 | Linner et al. | 62/349 |
| 4,745,771 | 5/1988 | Linner et al. | 62/264 |
| 4,807,442 | 2/1989 | Linner et al. | 62/55.5 |

OTHER PUBLICATIONS

Louis Terracio and Karl G. Schwabe, Freezing and Drying of Biological Tissues for Electron Microscopy, Journal of Histochemistry and Cytochemistry vol. 29, No. 9, pp. 1021-1028 (1981).

U. B. Sleytr and A. W. Robards, Understanding the Artifac Problem in Freeze-Fracture Replication: A Review, The Royal Microscopical Society, pp. 103-123 (1982).

J. G. Linner, et al., A New Technique for Removal of Amorphous Phase Tissue Water Without Ice Crystal Damage: A Preparative Method for Ultrastructural Analysis and Immunoelectron Microscope, The Journal of Histochemistry and Cytochemistry, vol. 00, No. 0 (1986).

*Primary Examiner*—Henry A. Bennett
*Assistant Examiner*—Denise L. F. Gromada
*Attorney, Agent, or Firm*—Arnold, White & Durkee

[57] ABSTRACT

This invention relates to an apparatus and method for distillation drying of one or more biological samples. The drying apparatus includes a retaining assembly, a vacuum assembly, cooling means, monitoring means and control means for actively regulating the temperature and pressure conditions of biological tissue so that such tissue may be dried without substantial ultrastructural damage.

12 Claims, 3 Drawing Sheets

METHOD AND APPARATUS FOR CRYOPREPARING BIOLOGICAL TISSUE

This is a divisional of application Ser. No. 07/395,028, filed Aug. 17, 1989, now U.S. Pat. No. 4,964,280.

BACKGROUND OF THE INVENTION

1. Field of the Invention

This invention relates to an apparatus and method for molecularly distilling ("drying") fluids from biological tissue. The dried tissue can be stored or otherwise used for any intended purpose. Experimentation has shown that the apparatus and method of this invention have demonstrated utility with tissue of various sizes and configurations. The specific end use of the tissue being dried is not considered a limiting factor in this invention.

Although the phrase "tissue sample" (the term "tissue" is used interchangeably with the term "tissue sample") is used throughout this disclosure, the term should be understood to include any material composed of one or more cells, either individual or in complex with any matrix or in association with any chemical. The definition shall include any biological or organic material and any cellular subportion, product or by-product thereof. The definition of "tissue sample" should be understood to include without limitation sperm, eggs, embryos and blood components. The contemplated utility of the apparatus of this invention is not limited to specific types or sizes of tissue. The apparatus of this invention can be designed or adapted to any size, shape or type of cellular tissue. Therefore, the terms "tissue" and "tissue samples" are used interchangeably and are not limiting on the uses to which the method of this invention can be placed.

Also included within the definition of "tissue" for purposes of this invention are certain defined acellular structures such as dermal layers of skin that have a cellular origin but are no longer characterized as cellular. The term "component particles" is sometimes used as a generic reference to subunits making up "tissue" and should be understood to refer to molecules, individual cells or other subunits of tissue.

In one preferred embodiment of this invention the apparatus is used in conjunction with the preparation of tissue for ultrastructural analysis. Specifically, it is difficult to interpret the results of tissue analysis while concomitantly assessing the extent of various artifacts produced during the tissue preparation process. It is thus essential that artifacts be avoided wherever possible. The term "artifact" refers to a product of artificial character due to an extraneous agency. Another problem results from physical shrinkage of the tissue sample itself when subjected to the extreme procedures extant in current dogma. In most currently used tissue preparation steps, tissue shrinkage is in the order of 10% to 20%. This shrinkage inevitably results in alteration of ultrastructure and massive rearrangement of intrastructural resolution. The net result of this is ultrastructural translation damage and inaccurate detail in descriptions via existing analytical procedures.

During the so-called "Golden Age of Morphology" the predominant underlying goal in qualitative and quantitative microscopy has been an aesthetically pleasing image. This goal is readily attainable with the fixation methods and apparatus which are currently available. However, it has become essential in certain contexts that the aesthetically pleasing image, which is produced by the preparation process, also yield a tissue sample which accurately reflects the true condition of tissue in the living organism, i.e., approaching the "living state." Magnification apparatus which are currently available for analytical use are technically more advanced than current tissue preparation techniques which have been previously employed. The method of this invention results in the preparation of tissue samples which are readily usable on known magnification and analytical apparatus. Therefore, when used in conjunction with known cryopreparation-apparatus and methods the drying apparatus of this invention can be used to prepare tissue in essentially the "living state."

The "preparation" of tissue should be understood to refer to preparation of tissue for analysis as well as the drying of tissue in anticipation of transplantation, modification, in vitro or in vivo cellular growth, fertilization, animated suspension or the more typical resin impregnation, setting, infiltration and analysis. The method of this invention can be used to prepare tissue for any medical or analytical procedure.

The apparatus used in the practice of this invention is to be distinguished from contemporary freeze-drying apparatus. Freeze-drying is a technique which is well known in the art together with the equipment necessary to implement such freeze drying. See, for example, U.S. Pat. No. 4,232,453. Although in certain freeze-drying techniques liquid nitrogen is used as a cooling medium, the tissue or sample itself does not attain a temperature approaching that of liquid nitrogen.

The vacuum levels disclosed and used in the apparatus used in the practice of this invention cannot be achieved safely with prior art freeze drying equipment. Typical of previous methods for drawing vacuums in freeze drying methods and apparatus is the above-mentioned U.S. Pat. No. 4,232,453 which discloses the use of molecular sieves in glass containers. Molecular sieves in easily compromised containers cannot be used safely to create and maintain the required vacuum levels to achieve the partial pressures required for sublimation of water at the anticipated temperatures (−120° C. or below) created by the apparatus of the disclosed invention.

Throughout this specification the terms "distillation" and "distillation drying" are used. For purposes of this application the terms should be understood to refer to the removal of liquid or solid materials, typically in molecular form, from a crystalline lattice. The term is intended to include sublimation and other physical processes whereby liquids, solids or materials that are present in a transition state between liquid and solid are removed. The specific characterization of the materials being removed from samples by the "distillation" process of this invention depend at least in part on the surface physics by which molecules are present within the crystal lattice of the material to be removed. Typically, molecules are removed from the tissue at the saturation vapor pressure of the material to be removed.

2. The Prior Art

Apparatus and methods for drying biological tissue in the past have been somewhat conventional. For example, as explained above freeze drying has been a well known technique for preparing and drying certain materials in the past. Other techniques involving conventional ovens and other heating methods have been known and used for many years. However, the process and apparatus of this invention have broken through conventional technical barriers. Under optimal conditions, water is molecularly distilled from tissue, preventing the ultrastructural and morphological damage that has previously been thought to be inherent in tissue drying.

Similarly, it is essential that drying methods and apparatus develop concurrently with other medical technology, i.e., surgical transplant techniques, bioengineering and biogenetics. In short, drying is an essential intermediate step in evolving processes using or analyzing cells or tissue. If drying apparatus does not evolve then the thrust of medical technology into unexplained and unexplored medical arts will be blunted. The method of this invention represents a drying breakthrough that will permit research into the use and preparation of biological tissue to keep pace with other advances in medical technology.

The most common alternative to chemical fixation and organic solvent dehydration is freeze drying cryofixed samples. Freeze-drying following cryofixation is a well documented and well known technique for tissue preservation. It has several advantages. Cryofixation results in a near-instantaneous arrest of cellular metabolism. Freeze drying results in a stabilization and retention of soluble cell constituents through elimination of solvent contact with the sample. These are significant advantages to cryofixation freeze-drying that have resulted in a great deal of research in attempting to apply cryofixation and freeze-drying techniques to known tissue preparation processes. Unfortunately, freeze-drying technology inherently possesses a number of disadvantages relevant to tissue preparation methodologies. These disadvantages deal primarily with damage to the cell ultrastructure during drying.

This general topic is discussed in some detail together with other prior art methods in an article entitled *Freezing and Drying of Biological Tissues for Electron Microscopy*, by Louis Terracio and Karl G. Schwabe, published in The Journal of Histochemistry and Cytochemistry, Volume 29, No. 9 at pp. 1021–1028 (1981). problems associated with artifact formation are described in *Understanding the Artifact Problem in Freeze-Fracture Replication: A Review*, The Royal Microscopial Society, (1982) at pp. 103–123.

The particular physical state that the tissue is in when subjected to the drying process of this invention is not a limiting factor. In certain applications where ultrastructural damage must be controlled and minimized a cryoprepared tissue sample is used. Other applications do not require the absence of ice crystals and the tissue may be dried from the frozen condition. In even other situations a "room temperature" tissue sample can be used in the apparatus and method of the invention. The specific starting material and the physical or physiological conditions of the starting material are not limiting factors. The only essential characteristic of the tissue for use in the process and apparatus of this invention is that a distillable liquid, usually water, be present within the chemical structure of the tissue sample.

Dehydration is an essential step in the preparation of biological tissue samples for storage and a step which oftentimes results in the destruction via reticulation of the infrastructure and ultrastructure of the tissue. Tissue cell destruction from dehydration not only impairs analysis by magnification apparatus but also adversely affects the functional characteristics and viability of tissue masses being used, i.e. transplanted.

In certain prior art drying techniques, the tissue sample had not been entirely solidified due to eutectic formation as the cellular fluid solutes were concentrated in bound water compartments. This transfer of solute occurs while the materials are in the fluid state when slow cooling is employed. When rapid cooling techniques are used, unique procedures, which are distinct from those characteristic of freeze-drying, must be employed in the dehydration step. Problems result from the fact that dehydration must take place (the water must be removed) in the solid rather than the liquid state, i.e., via sublimation.

Also in the prior art, an alternative method of dehydration is referred to as the freeze substitution approach and involves the removal of tissue water by substituting a solvent or solvent-fixative mixture for the solid phase water at −50° C. to −80° C. This introduces less severe solvent phase separation and chemical alteration artifacts to a tissue sample than past routine chemical fixation methodologies.

From a practical standpoint freeze-drying is complicated by the requirement that the tissue sample be warmed to increase the vapor pressure of the supercooled water and to allow sublimation to proceed in a reasonable period of time. The increased temperature, in addition to increasing vapor pressure, can produce a series of physical events leading to the expansion of ice crystals and concomitant damage to the ultrastructural morphology of the tissue sample. Many of the physical events which occur during the warming process have to do with transitions in the physical state of the water which is present. Changes which are typically encountered are glass transition, devitrification and crystallization with an ensuing series of crystal lattice configurations.

The apparatus and method of this invention, which have been used successfully, are sometimes referred to as stimulated molecular distillation. Stimulated molecular distillation refers to a process in which the amount of energy in the antibonding orbitals of surface molecules is elevated, enabling the molecules to escape to the gas phase and not be recaptured by the solid phase.

SUMMARY OF THE INVENTION

Figure 1:
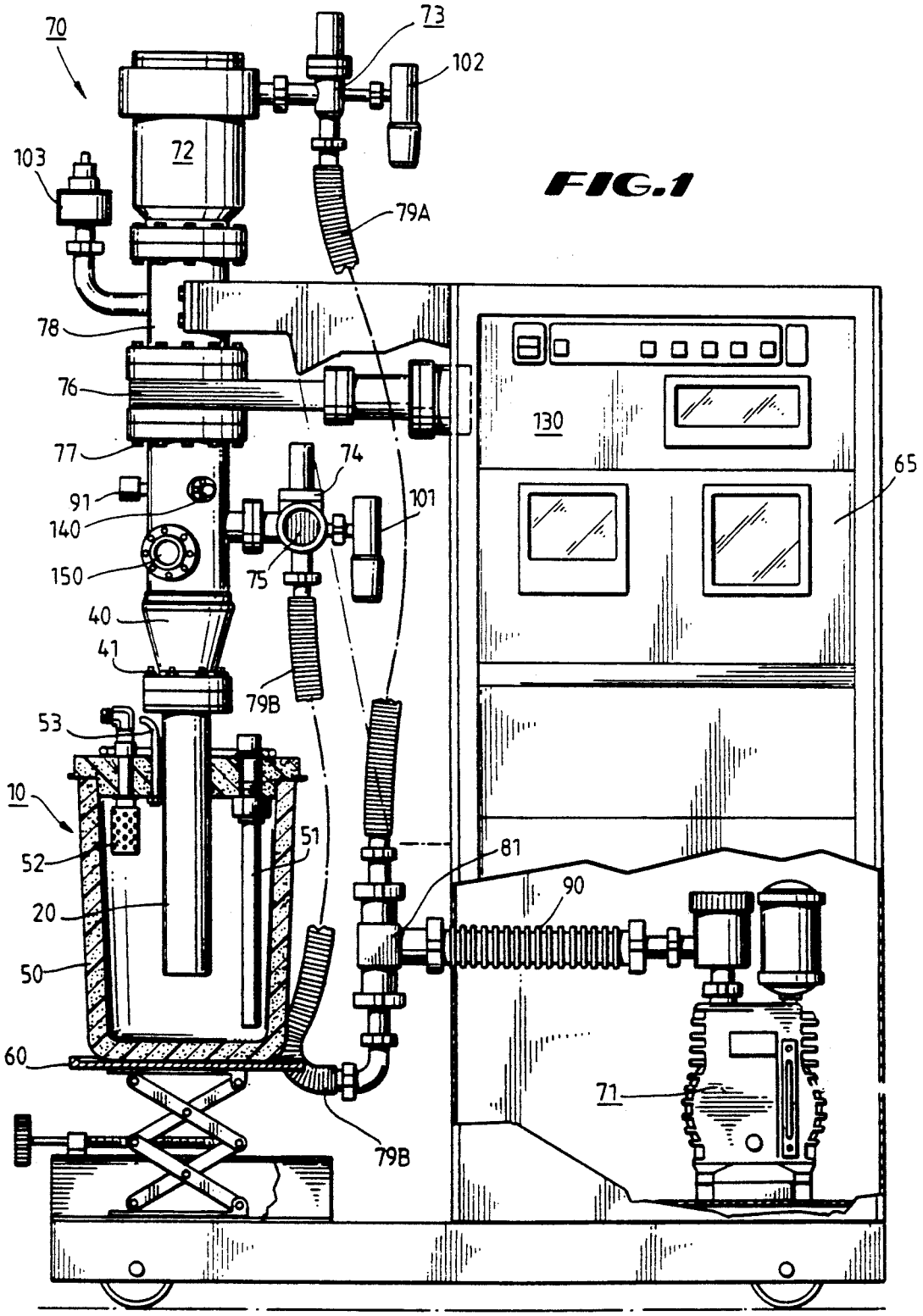
FIG. 1 is a schematic drawing of the drying apparatus of this invention.

The apparatus of this invention will be alternately referred to as a "dryer" or a "distillation dryer" or in its most preferred form as a "molecular distillation dryer." It will be understood that for purposes of this application these terms are used interchangeably and refer to the same apparatus. It should also be understood that the drying apparatus of this invention has been specifically and uniquely designed to address the critical needs for drying cryofixed biological samples. However, it should be further understood that the apparatus of this invention does not include cryofixation means and that any tissue samples, whether cryofixed or not, may be dried in the process and apparatus of this invention.

As explained hereinbefore the problems associated with biological tissue preparation involve in essence the avoidance of ice crystal formation. As explained in other commonly assigned patents and patent applications, see for example U.S. Pat. Nos. 4,510,169; 4,567,847; 4,676,070; 4,707,998; 4,745,771 and 4,807,442, it is now possible to cryoprepare biological tissue without the formation of resolvable ice crystals. When such a cryofixed or cryoprepared tissue sample is placed in the molecular distillation dryer of this invention it can be dried without substantial ultrastructural damage as would typically be caused by the removal of ice crystals, i.e. freeze drying. These drying phenomena have been successfully practiced with cryofixed tissue samples as well as with noncryofixed tissue samples based on the following principles:

1. The vacuum within the sample chamber is sufficiently low that the partial pressure of the water vapor surrounding the sample is lower than the saturation water-vapor pressure of the various solid states within the sample being dried at a given temperature.
2. Efficient water removal requires that condenser surfaces surround the sample and be in direct line of sight with the samples. Additionally, the samples are considerably closer to the condenser than the length of the mean free path of water molecules within the vacuum chambers. The mean free path is defined as the distance traversed by a water molecule before it collides with, and is deflected by, another water molecule.
3. Tissue sample temperature is precisely controlled by thermocoupled feedback to a microprocessor which regulates a heating element and permits incremental heating of the sample at preprogrammed rates.
4. The unique configuration of the sample holder of the drying apparatus protects the sample from uncontrolled radiant heat and permits maximum use of conductive heat from below and all sides of a sample well.
5. Sample rehydration must be prevented both during and at the end of the drying process. The molecular dryer of this invention includes a condenser surface that is closer to a high vacuum source than the mean free path of water molecule in the vacuum chamber and is in direct line of sight. In this fashion water collected on the sample chamber walls has an unobstructed path when it is slowly allowed to be released due to slow evaporation of liquid nitrogen from an outer dewar. This configuration prevents water molecules rehydrating the sample.

In its broadest form the molecular distillation dryer of this invention includes a retaining assembly which is specifically designed to retain one or more biological samples. Vacuum means are functionally attached to the retaining assembly with monitor means functionally attached to the retaining assembly to monitor temperature and pressure.

The retaining assembly of this invention includes as its primary components a column for connecting the vacuum pumping elements to the retaining assembly, a sample chamber, a sample holder and a dewar with associated cooling components surrounding said chamber and holder.

The vacuum means of this invention are functionally connected to the retaining assembly and includes as primary components a high vacuum pump for achieving a high vacuum and a vane pump for achieving a rough vacuum. Also associated with the pumping means are a backing valve, a roughing valve and a gate valve. Other hardware is likewise associated with the vacuum means.

Finally, it is preferred for the most efficient functioning of the apparatus and method of this invention that temperature be constantly monitored. Likewise, a monitoring assembly is provided that is functionally connected to the retaining assembly and to the vacuum means. In the preferred embodiment Pirani sensors are used to measure the low vacuum levels on the backing side of the turbo pump and within the column connecting the vacuum means to the retaining assembly. A Penning gauge is used to measure the high vacuum in the system. A temperature controller, a vacuum monitor and a chart recorder are also optional components of the monitoring assembly.

Other equipment that may be associated with one or more embodiments of the apparatus of this invention includes a blowout valve, a vapor fixation assembly and a resin input assembly. The vapor fixation assembly and resin input assembly are designed for use primarily with electron microscope applications of the process and apparatus of the invention. All of the components of the invention are optimally designed for use with cryofixed samples. However, as has been stated herein before the use of cryofixed samples is not critical to the practice of the process and use of the apparatus of this invention.

DETAILED DESCRIPTION OF THE PREFERRED EMBODIMENT

In the use of the apparatus of this invention, it is a fundamental prerequisite that the desired biological sample be obtained. Biological samples are collected by a variety of means, i.e. surgical extraction, withdrawn blood samples, binders, cell cultures, cellular based dermal samples, and any of a variety of other techniques which are well-known and conventional. The particular method of obtaining the biological sample is not limiting on the use of the apparatus of this invention. However, the preparation of the tissue sample in the apparatus of this invention is enhanced if the tissue sample is processed as soon after excising as is possible.

After the tissue sample is obtained, it may be further treated prior to drying or it may be placed in the dryer in an "as is" condition. In certain instances, the tissue sample may be retained in a fixative, i.e. formaldehyde, or another biologically active stabilizing solution, in an attempt to maintain the sample during shipping, storage or other necessary operations. It is also possible that the sample may be frozen or otherwise physically or chemically modified prior to drying in the apparatus of this invention. In one preferred embodiment of this invention the tissue sample is cryofixed prior to drying. The cryofixation of biological tissue is discussed in more detail in commonly assigned U.S. Pat. No. 4,807,442, the disclosure of which is incorporated herein by reference. The particular method of tissue preparation, i.e. chemical fixation, freezing, cryofixation, or other methods are disclosed by the prior art. The particular method of tissue preparation prior to drying is not part of the inventive apparatus or method of this invention.

Retaining Assembly

Figure 2:
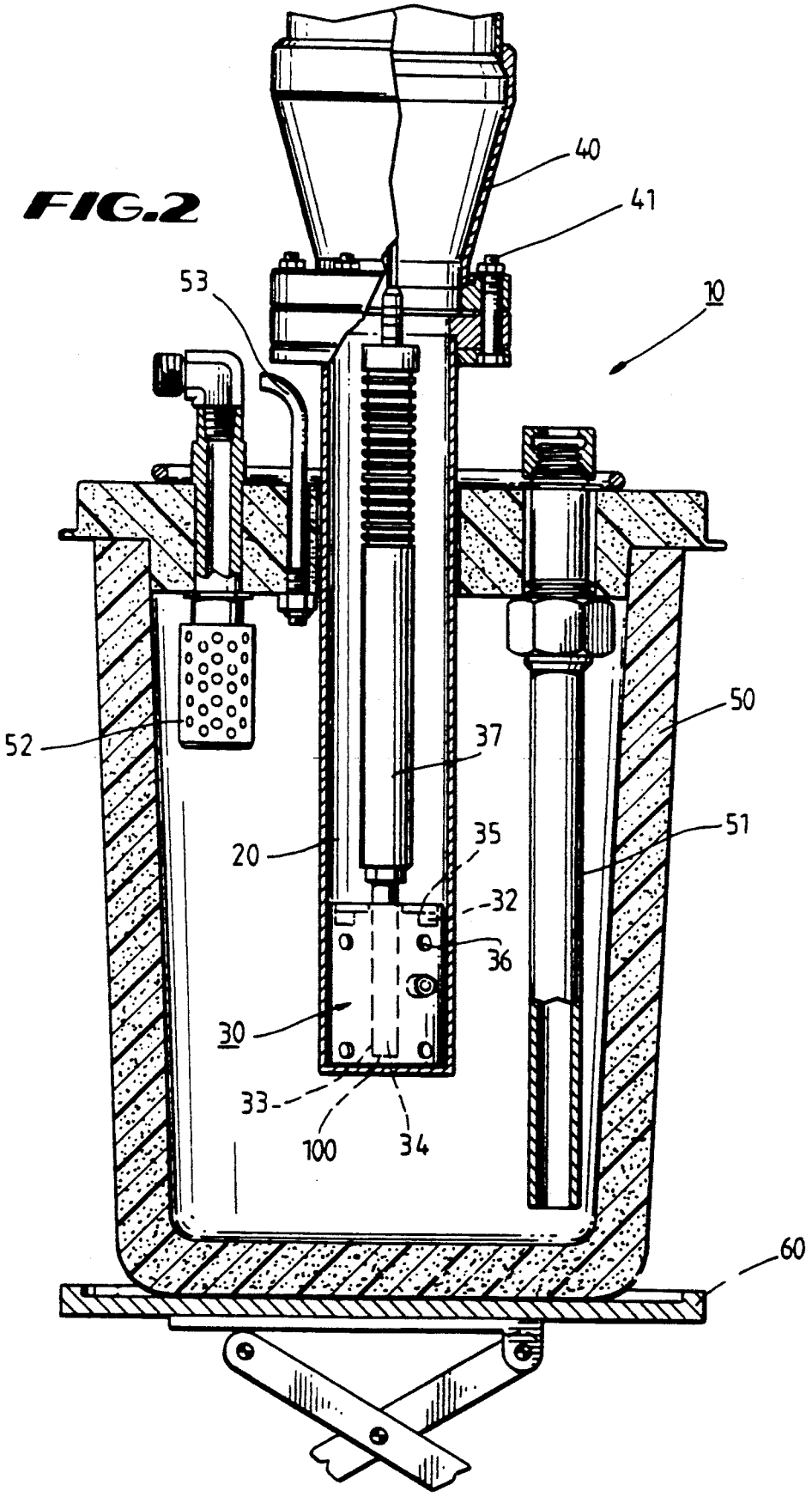
FIG. 2 is an enlarged cross-sectional view of the retaining apparatus of this invention together with the surrounding sample chamber.

The retaining assembly 10 is removably attached to a metallic column 40 by bolts 41. Referring specifically to FIG. 2, the retaining assembly is shown in schematic detail. In its broadest form, the retaining assembly includes a sample chamber 20 and a sample holder 30. The biological sample (not shown) is placed within individual wells 32 within sample holder 30 and then the entire sample holder 30 assembly is placed into sample chamber 20. Details of the sample holder are described in commonly assigned U.S. Pat. No. 4,745,771 which is hereby incorporated by reference.

It is essential to the proper functioning of the distillation drying apparatus of this invention that the sample holder 30 be sized and designed to be fitably received by sample chamber 20.

In its most preferred embodiment, the sample holder 30 consists of a solid block of thermally conductive metal 31, preferably copper, silver, gold, sapphire, or diamond, and combinations or alloys of copper, silver, gold, sapphire or diamond. In one preferred embodiment, an alloy of silver and copper plated with gold is used. In another preferred embodiment, a solid sapphire block or sapphire coated metallic block is used. In still another preferred embodiment, a metallic block is diamond coated. These illustrations of the preferred embodiment are not intended to be limiting on the invention. Any combination of materials that are functionally effective, i.e. thermally conductive, at the temperatures and pressures encountered in the subject process and apparatus can be used.

A plurality of wells 32 have been created in one surface of metal block 31. In the most preferred embodiment, fifty wells 32 are arranged in a circular configuration. The specific arrangement of wells 32 in solid block 31 is not critical, although functional limitations facilitating heating and fluid removal must be observed.

A central aperture 33 is found in metal block 31. Radiant and conductive heating means 34 is insertable into aperture 33. The wells 32 create tissue reservoirs. The biological tissue samples are individually inserted into reservoirs 32 with forceps.

In the most preferred embodiment, after insertion, the tissue samples are then covered with a reservoir cover 35. Reservoir cover 35 includes a wire mesh section which is secured by means of a spring retaining ring. Reservoir cover 35 also functions to protect the biological samples from the effects of sudden changes in pressure such as when some of the valving is opened or closed.

Teflon ® spacers 36 are intermittently spaced around the exterior surface of solid metal block the proper spacing from the wall or other surface of sample chamber 20. A Teflon ® sleeve 37 is threaded into central aperture 33 to protect the connecting wires which lead to power source and temperature monitors.

In the most preferred embodiment of the invention, the radiant heating means 34 is a cartridge heater. The heating mechanism is selectively activated manually or preferably by a programmable computer or microprocessor to maintain the desired temperature or temperature rate of change. Upon heating, the thermally conductive block 31 conducts heat energy to the tissue reservoirs/wells 32 and heat energy is absorbed by a spectral coating on the reservoir covers 35 and/or the side walls of wells 32. The spectral coating then acts as the source of radiant heat to the tissue samples.

The sample chamber 20 is used to retain the sample holder 30. The Teflon ® sleeve 37 also acts as a handle for inserting the sample holder 30 into the sample chamber 20. Sample chamber 20 is then attached via bolts 41 to column 40.

The entire sample holder 30 and sample chamber 20 assembly is inserted into a cryo reservoir 50 that includes an cryogen level sensor 51 together with a vapor phase separator or difusser 52 for a cryogen and a vent 53 to vent gases from an evaporated cryogen. In a most preferred embodiment, a cryogen such as liquid nitrogen fills cryo reservoir 50 to the desired level via diffuser 52 to maintain a cryogenic temperature in sample holder 30. Preferably, the cryoreservoir 50, sample holder 30, sample chamber 20 and other elements of the retaining assembly 10 are mounted or placed on a platform 60 which can be conveniently raised and lowered to facilitate operation of the drying apparatus.

The Vacuum Assembly

It is essential to the effective functioning of the distillation drying apparatus of this invention that a depressurization occur in the sample chamber 20. Depressurization is effected by one or more vacuum pumps. In the preferred embodiment of this invention a roughing pump causes an initial vacuum which for purposes of this application will be defined as from 1 to $1\times10^{-3}$ millibar and then a second high vacuum pump pulls a high or ultra high vacuum which for purposes of this patent application will be understood to mean a vacuum of more than $1\times10^{-3}$, i.e., $1\times10^{-3}$ to $1\times10^{-13}$.

A variety of pumping apparati have shown functional effectiveness in the apparatus and method of this invention. The preferred types of pumps are sorption pumps, fluid entrainment pumps and turbo pumps. The pumping apparatus used in the distillation drier of this invention are available commercially from a variety of manufacturers.

There are at least two types of pumps that are necessary for effective functioning of the drying apparatus of this invention. The first is a low pressure pump and the second is a high pressure vacuum pump. The low pressure pump is alternatively referred to as a roughing pump and in certain instances a backing pump. In the most preferred embodiment of this invention the roughing pump and the backing pump are one in the same and are connected by valving. These pumps are readily available commercially together with literature describing their capabilities and functionality.

The preferred high vacuum pump is a turbomolecular pump. The functioning of the turbomolecular pump depends on the fact that gas particles to be pumped receive, through impact with the rapidly moving surfaces of a rotor, an impulse in a required flow direction. The surfaces of the rotor within the turbomolecular pump, usually in the form of discs, form with the stationary surfaces of a stator, intervening spaces in which the gas is transported to a backing port. In the most preferred embodiment of the current invention a turbomolecular pump having magnetic levitation bearings is used. Such a pump has its turbine motor suspended in all five degrees of freedom by electromagnets situated inside the pump. This places an emphasis during operation on the absence of vibration, friction and hydrocarbons, both important characteristics in the operation of pumps and the creation of vacuums under the temperatures and conditions of this invention.

Alternate embodiments of the invention use other "sorption pumps" which include all hardware arrangements whereby gases and vapors are removed from a space by sorption means. The pumped gas particles are bound at the surfaces or in the interior of sorption means and either on the basis of physical temperature—dependent absorption forces, chemical sorption, or finally, by becoming embedded in the course of continuous formation of new sorbing surfaces, are removed from the desired area.

The two types of sorption pumps are adsorption pumps, in which the sorption of gases takes place simply by temperature controlled adsorption processes and getter pumps, in which the sorption and retention of gases are essentially due to the formation of chemical compounds produced on continuously created new adsorbing surface films. The getter materials are either evaporated (in sublimation pumps) or sputtered (in sputter-ion pumps).

The final type of pump that has shown utility in the apparatus and process of this invention is a cryopump. A cryopump is a vacuum pump which consists inherently of a surface cooled to a temperature of less than 120° K. so that gases and vapors condensed at this surface or get adsorbed if cooled adsorption media are used. The cold surface may be situated in the vacuum vessel itself.

Referring now specifically to FIG. 1 the pumping means of this invention will be more completely described. The pumping means are referred to generally by the numeral 70. The pumping means include a roughing pump 71, a high vacuum pump 72, a backing pump connector and valve 73, a roughing pump manifold 74, a roughing valve 75, as well as a gate valve 76.

An electropneumatic, ultra high vacuum pendulum gate valve 76 comprises the main valve isolating the turbo molecular pump 72 from the sample chamber 20. A piston contained within a piston housing provides the mechanism for opening and closing gate valve 76. A solenoid valve and nitrogen gas are used to actuate the opening of gate valve 76.

As illustrated more specifically by FIG. 2 the retaining assembly 10 is removably attached to the column 40 by bolts 41. Likewise the upper surface of column 40 is attached to gate valve 76 by bolts 77. Gate valve 76 is attached to a connector spool 78 which in turn is connected to high vacuum pump 72. High vacuum pump 72 is connected through backing pump connector mechanisms 73 to vacuum tubing 79A to elements of the roughing and backing pumps 71 (shown as the same component in FIG. 1). Backing pump 71 and backing connector assembly 73 include backing valve 80.

Also part of the vacuum means 70 is roughing valve 75. Roughing valve 75 is connected through hose 79B to "T" 81 which is then connected to roughing pump 71. In the preferred embodiment as illustrated in FIG. 1 roughing pump 71 and backing pump 71 are the same pump. The roughing and backing functions are handled alternatively by the interconnection of the vacuum means 70 through roughing pump manifold 74, roughing valve 75, vacuum tube 79B, "T" 81, and ultimately vacuum tube 90 which connects directly to the roughing/backing pump 71.

In operation the gate valve 76 is closed when the sample chamber 20 is initially raised into a functional relationship to the metal cylinder 40. Roughing pump 71 is activated and "T" 81 is configured to permit fluid flow through tube 79B and roughing valve 75 is opened. In this configuration an initial vacuum from 1 to $1\times10^{-3}$ millibars can be drawn by roughing/backing pump 71. When the appropriate prepressure has been drawn gate valve 76 is opened and high vacuum pump 72 is activated. While high vacuum pump 72 is activated it is preferred that backing pump 71 also be activated. This is effected by opening backing valve 73 which connects through hose 79A to backing pump 71. During the backing operation "T" 81 is configured to permit flow through vacuum tube 79B but not through vacuum tube 79A.

In other less preferred embodiments of this invention a separate backing pump is attached through backing valve 73 to high vacuum pump 72. In such an embodiment the backing pump and roughing pump are separate from one another.

Also part of the vacuum means is blowout valve 91 which is alternately referred to as the over pressure relief valve. The configuration and utilization of valve 91 are conventional.

The Monitoring Assembly

It is necessary to monitor the temperature chamber 20 to approximate the temperature of the various samples. The temperature is monitored by temperature sensor 100 shown more specifically in FIG. 2. Temperature sensor 100 is functionally associated with metal block 31 to approximate the temperature of the portion of the sample holder 20 and sample chamber 30 in which the tissue samples have been placed.

In addition to the necessary temperature measurement it is also desirable to measure the vacuum of the various components of the drying apparatus of this invention. Such monitoring requires both high and low vacuum gauges. Pressure gauges are available commercially to cover the range of vacuums down to $10^{-13}$ millibar. For measurement in such a wide pressure region, measuring instruments are used which are known as vacuum gauges. Since it is impossible on fundamental physical grounds to build a vacuum gauge which can give quantitative measurements in the whole vacuum region, a series of vacuum gauges are available, each of which has a characteristic measuring range, which mostly extends over a few orders of magnitude. The measuring range of an individual vacuum gauge is limited at both ends of the range by physical phenomena.

Referring specifically now to FIG. 1 it is shown that a low pressure vacuum gauge 101 is attached to roughing pump manifold 74. The high pressure, low vacuum gauge 101 is referred to as a Pirani gauge. Likewise, another high pressure vacuum gauge (Pirani gauge) is found at 102 in attachment to the backing valve 73. Finally, the high vacuum gauge 103, referred to as a Penning gauge, is found attached to connector spool 78. These gauges are functionally connected to measuring apparatus such as a chart recorder, microprocessor and other conventional control apparatus shown genericly by the number 130. With these gauges the low vacuum, high vacuum and temperature of the drying apparatus of this invention are monitored and ultimately controlled.

A microprocessor 65 located within the control unit 130 is the component used to read and control the temperature of the tissue samples in sample holder 30. Microprocessor 65 receives the temperature of the metal supporting the tissue samples in sample holder 30 from temperature sensor 144. While the tissue sample itself is not directly contacted by the temperature probe, the temperature of the metal supporting the tissue samples in sample holder 30 closely approximates the temperature of the tissue samples. The programmable features of the microprocessor 65 enable the implementation of a temperature control function as well as a temperature monitoring function.

Vapor Fixation and Resin Impregnation

Figure 3:
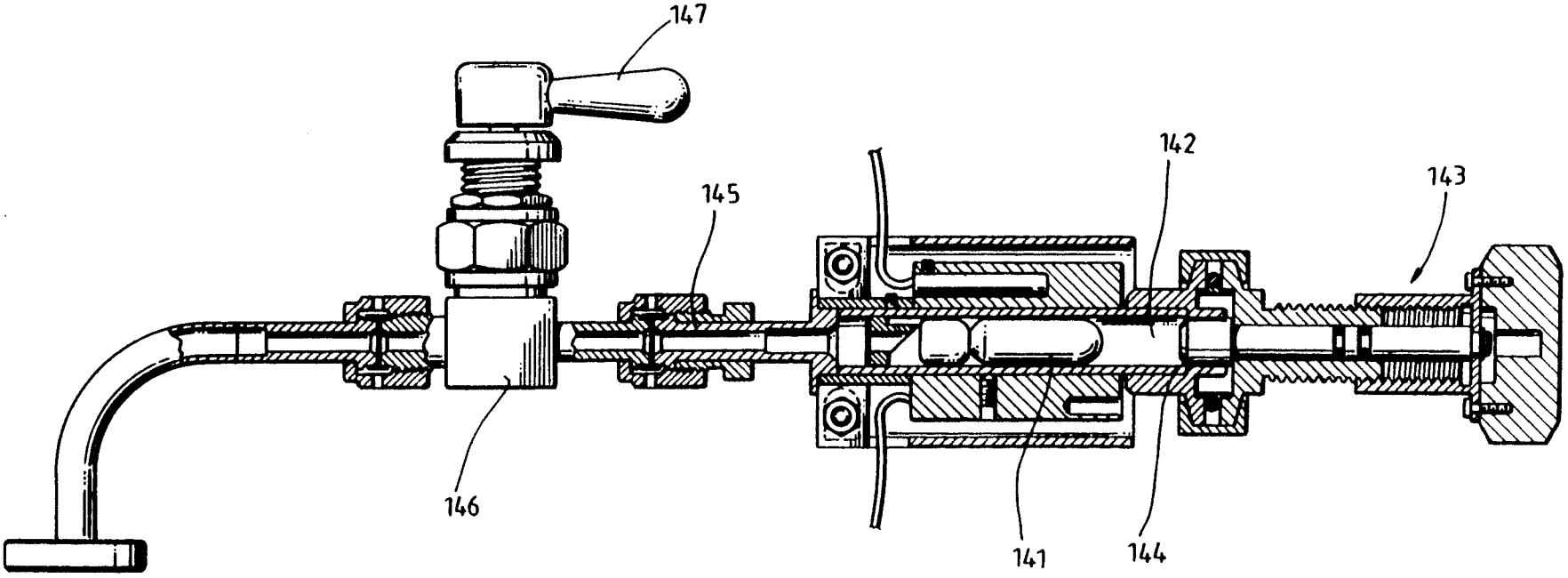
FIG. 3 is an enlarged schematic vie of the vapor fixation means of this invention in cross section.

At the conclusion of the drying process, the investigator has the option of exposing the tissue to osmium vapors for approximately one hour to provide contrast enhancement via increased electron density. This may be omitted if proven to be deleterious to the moiety of interest or if the ultimate goal is clinical use. Referring now specifically to FIG. 1 and FIG. 3 the vapor fixation assembly of this invention is demonstrated. Specifically, a vapor fixation port 140 is formed as an integral part of metal connector 40 (see FIG. 1). The vapor fixation apparatus that is connected to port 140 is illustrated schematically in FIG. 3. A vapor cartridge 141, tissue fixatives such as osmium tetroxide, aldehyde or any other fixing agent, is inserted into cylinder 142. A threaded activating mechanism 143 may then be rotated to cause relative movement of piston head 144 in cylinder 142. When sufficient pressure is applied to a sealed cartridge 141 by piston head 144 the cartridge 141 releases the contained vapor. The release vapor is then forced through vapor tube 145 and into metal connector 40 and ultimately into contact with the dry biological samples. Flow of vapor through vapor tube 145 is controlled by closure valve 146. Closure valve 146 is operated manually by handle 147.

In other established fixation processes, paraformaldehyde and/or glutaraldehyde is used. These materials are typically referred to as chemical-fixative materials. The most preferred material which is typically added is osmium tetroxide. This material will enhance the contrast of the various constituents of the tissue for the various analytical apparatus which might be used to interpret the tissue sample.

For samples prepared for analysis a degassed resin is then added to the tissue through resin infiltration port 150 while still maintaining the depressurized condition. In one preferred embodiment a syringe is used to introduce resin. A syringe port (not shown) is used and flow of the resin is controlled by a high vacuum valve (not shown). This is typically referred to as resin infiltration and results in an embedded tissue sample. Resins which have shown utility in past methods are equally applicable to the method of this invention. See for example U.S. Pat. Nos. 3,679,450; 4,100,153; 4,120,991 and 4,278,701.

Subsequent to these steps the tissue sample and resin are brought to atmospheric pressure by slowly admitting air or inert gas through the resin port 150. The embedded tissue sample which has resulted from the resin application process is removed and the resin is polymerized at its prescribed temperature. The particular method of polymerization is largely dependent on the resin that is used. Typically, the tissue sample is polymerized by application of electromagnetic energy in an oven for 12 hours. A normal temperature would be 60° C., but may be as low as −80° C., if necessary. It is essential that the polymerization step be accomplished without damage to the tissue ultra-structure.

Following polymerization the tissue sample can then be stored at room temperature, then sectioned, stained or further prepared for other analysis.

Although the preferred embodiment of the drying apparatus of this invention has been described hereinabove in some detail, it should be appreciated that a variety of embodiments will be readily available to a person designing an apparatus for a specific end use. The description of the preferred drying apparatus of this invention is not intended to be limiting on this invention, but is merely illustrative of the preferred embodiment of this invention. Other drying apparatus and arrangement of components which incorporate modifications or changes to that which has been described hereinabove are equally included within this application.

What is claimed is:

1. A method for distillation drying one or more biological samples comprising:

a) preparing one or more biological samples for insertion into drying apparatus;

b) decreasing the pressure of the atmosphere surrounding said one or more biological samples; and c) controlling the temperature and pressure conditions of the atmosphere surrounding said one or more biological samples such that transitional fluid molecules are distilled from said one or more biological samples until said samples are dry, said drying taking place without causing substantial ultrastructural damage.

2. The method of claim 1 wherein said decrease in pressure is to an initial rough vacuum of 1 mbar to $1\times10^{-3}$ mbar and to a second high vacuum of below $1\times10^{-3}$ mbar.

3. The method of claim 1 wherein said one or more biological samples are frozen prior to insertion in said drying apparatus.

4. The method of claim 1 wherein said one or more biological samples are cryofixed prior to insertion in said drying apparatus.

5. The method of claim 1 further comprising the step of vapor fixating said one or more biological samples after said transitional fluid molecules have been removed.

6. The method of claim 1 further comprising the step of resin impregnating said one or more biological samples after said transitional fluid molecules have been removed.

7. A method for distillation drying one or more biological samples comprising:

a) preparing one or more biological samples for insertion into drying apparatus;

b) decreasing the pressure of the atmosphere surrounding said one or more biological samples to a rough vacuum of 1 mbar to $1\times10^{-3}$ mbar;

c) subsequently decreasing the pressure of the atmosphere surrounding said one or more biological samples to a high vacuum of below $1\times10^{-3}$ mbar;

d) controlling the temperature and pressure conditions of the atmosphere surrounding said one or more biological samples such that transitional fluid molecules are distilled from said one or more biological samples until said samples are dry, said drying taking place without causing substantial ultrastructural damage.

8. The method of claim 7 wherein said one or more biological samples are frozen prior to insertion in said drying apparatus.

9. The method of claim 7 wherein said one or more biological samples are cryofixed prior to insertion in said drying apparatus.

10. The method of claim 7 further comprising the step of vapor fixating said one or more biological samples after said fluid molecules have been removed.

11. The method of claim 7 further comprising the step of resin impregnating said one or more biological samples after said fluid molecules have been removed.

12. A method for distillation drying one or more biological samples:

a) cryofixing one or more biological samples;

b) preparing said one or more cryoprepared biological samples for insertion into drying apparatus;

c) decreasing the pressure of the atmosphere surrounding said one or more biological samples to a rough vacuum of 1 mbar to $1\times10^{-3}$ mbar, said rough vacuum being drawn while the temperature of said biological samples is maintained below the water devitrification temperature of said samples;

d) subsequently decreasing the pressure of the atmosphere surrounding said one or more cryofixed biological samples to a high vacuum of below $1\times10^{-3}$ mbar while maintaining the temperature of said cryofixed biological samples to below the water devitrification temperature of said sample;

e) controlling the temperature and pressure conditions of the atmosphere surrounding said one or more cryofixed biological samples.

* * * * *